United States Patent [19]

Müller

[11] Patent Number: 4,972,797

[45] Date of Patent: Nov. 27, 1990

[54] APPARATUS FOR THE APPLICATION OF ADHESIVE TO A CONTAINER JACKET

[75] Inventor: Berthold Müller, Süssen, Fed. Rep. of Germany

[73] Assignee: GmbH & Co. KG, Donzdorf, Fed. Rep. of Germany

[21] Appl. No.: 309,258

[22] Filed: Feb. 13, 1989

[30] Foreign Application Priority Data

Mar. 23, 1988 [DE] Fed. Rep. of Germany ..... 3809756

[51] Int. Cl.[5] ..... B05B 9/03; B05B 7/12; B05B 7/16; B05C 7/02

[52] U.S. Cl. ..... 118/668; 118/58; 118/318

[58] Field of Search ..... 118/317, 58, 302, 306, 118/313, 663, 669, 679, 680, 691, 58, 306, 313, 317, 668, 667, 318; 427/230, 231, 236

[56] References Cited

U.S. PATENT DOCUMENTS

| | | | |
|---|---|---|---|
| 2,763,575 | 9/1956 | Dede | 118/302 |
| 3,019,938 | 2/1962 | Miller et al. | 118/317 |
| 3,044,441 | 7/1962 | Blakeslee et al. | 118/317 |
| 3,525,314 | 8/1970 | McClughan | 118/317 |
| 3,797,745 | 3/1974 | Haus | 118/317 |
| 4,043,295 | 8/1977 | Speck et al. | 118/317 |

FOREIGN PATENT DOCUMENTS

| | | | |
|---|---|---|---|
| 969476 | 9/1964 | United Kingdom | 118/317 |

*Primary Examiner*—Willard Hoag

*Attorney, Agent, or Firm*—Burns, Doane, Swecker & Mathis

[57] ABSTRACT

Adhesive is applied in a ring-shaped pattern to a surface of a jacket to enable a closure to be secured to the jacket. The jacket is held stationary, and a nozzle of an adhesive applicator is rotated to apply the adhesive. The nozzle is adjustable transversely of its axis of rotation to vary the distance between the nozzle and the jacket.

19 Claims, 1 Drawing Sheet

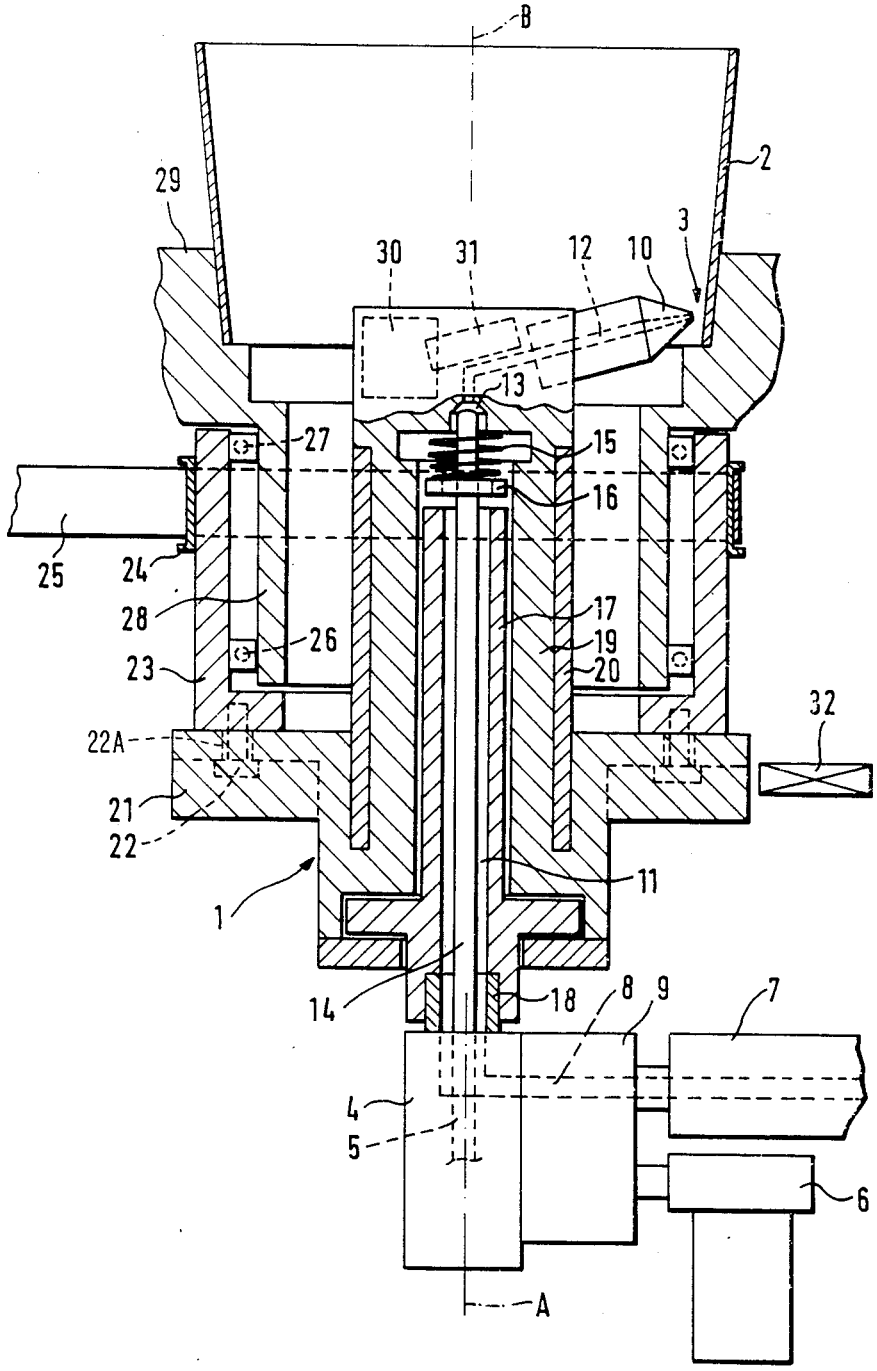
B
2
29
3
30
31
12
10
13
27
15
16
25
24
28
26
17
19
20
23
32
22A
21
22
11
1
14
18
8
9
7
4
5
6
A

APPARATUS FOR THE APPLICATION OF ADHESIVE TO A CONTAINER JACKET

BACKGROUND OF THE INVENTION

The invention concerns the application of an adhesive, in particular glue, in the form of a closed ring to a container jacket, especially by means of an applicator having a heatable, stationary housing and an applicator nozzle opened and closed by a valve actuated by a control piston.

Container jackets are usually formed by winding a flat blank of cardboard or plastic around a winding core, and the overlapping ends of the blank are welded or glued together. For the securement of a bottom closure into the container jacket, glue is often applied to the jacket in the form of a closed ring in the area of the jacket bottom. In the machines built heretofore it has been customary to rotate the jacket during the application of the ring of glue. This involves a complex arrangement for the securing of the container bottom, particularly in view of the fact that generally a plurality of jackets are to be rotated.

It is an object of the invention to modify known glue application devices so that the container jackets are held in a stationary manner during the application of the ring of glue.

SUMMARY OF A PREFERRED EMBODIMENT OF THE INVENTION

This object is attained in that the applicator nozzle is located at a distance from an adhesive supply housing and is connected with a rotating drive. The distancing of the applicator nozzle from the supply housing is necessary, because the nozzle must be angled relative to the glue feeder line in order to direct its orifice toward the container jacket. By means of the rotating drive the applicator nozzle is rotated around an axis which is preferably coaxial with the axis of the container jacket. It is possible in this manner to apply a closed ring of glue even if the container jacket is being held stationarily and to control the application process so that the application will begin in the area of the overlap of the ends of the blank. The application of the adhesive may thus be initiated at an accurately defined location of the container jacket, usually at the seam, and terminate at the same location. A double application of the adhesive may thus be carried out in the overlapping area.

Preferably, a valve is located in the immediate vicinity of the applicator nozzle. By placing the valve as near as possible to the discharge passage of the applicator nozzle, the formation of filaments and droplets may be prevented during the closing of the valve.

The valve is controlled by a control piston and a valve lifter extending from the piston to a valve stem. The applicator nozzle is preferably mounted on a rotating tube, which in turn surrounds a stationary tube. The stationary tube surrounds the adhesive feeder line, which extends from an adhesive supply housing to the applicator nozzle. The valve lifter is located inside the stationary tube and is spaced apart from it while supported in a floating manner, i.e., it is supported only in the area of the housing and the control piston so that the valve stem can float radially to facilitate being centered.

Preferably, both the applicator nozzle and the adhesive supply housing area heated to insure that the adhesive remains liquid. The rotating tube is equipped with insulation so that the heat losses remain low. In order to maintain the temperature of the adhesive within very narrow limits, the heater of the applicator nozzle is controlled by a thermostat. The applicator nozzle is preferably located on a slide displaceable transversely to its axis of rotation. This renders the distance of the applicator nozzle to the internal wall of the container jacket adjustable without having to vary the length of the nozzle. This adjustability is important, as the distance between the valve and the container wall should be as small as possible. If the cross-section of the container jacket is not circular but oval or rectangular, the slide may be guided by means of a curving guide so that the distance of the applicator nozzle to the container jacket remains approximately constant.

A sensor scanning the position of the applicator nozzle may be associated conveniently with said nozzle. This sensor may contain, for example, a light barrier which queries the position of the applicator nozzle and actuates the application of the adhesive. The length of the applied adhesive ring, i.e., the amount of rotation of the nozzle, may be controlled by means of a slotted disk mounted on the axle of the drive motor for the rotating drive. A similar function may also be performed by a shaft encoder, which transmits the position of the applicator nozzle to the controls and simultaneously measures the length of path or the angle of rotation. By means of such a shaft encoder the rpm of the applicator nozzle may be chosen so that it is synchronous with the machine. In this manner, the need for more than one revolution of the applicator nozzle to produce a ring of the adhesive is eliminated.

BRIEF DESCRIPTION OF THE DRAWING

The objects and advantages of the invention will become apparent from the following detailed description of a preferred embodiment thereof in connection with the accompanying drawings, in which like numerals designate like elements, and in which:

The sole FIGURE is a vertical sectional view through an apparatus according to the invention for the application of glue to the inside of a container jacket.

DETAILED DESCRIPTION OF A PREFERRED EMBODIMENT OF THE INVENTION

The container jacket 2, the axis of which is indicated by B, is to be provided in the area 3 of one end (preferably a lower end) with a closed ring of glue by means of a glue applicator device 1. The container jacket 2 is held by a stationary holder 29.

The glue applicator device 1 comprises a housing in which a control piston is reciprocably mounted, with its axis indicated by A. Glue is supplied by a glue feeder to a line 8 heated by a heater 9 . A solenoid 6 is provided which controls suitable valves (not shown) in the housing 4 for supplying working fluid to lower the piston and open the glue line 8, or conversely for raising the piston and closing the glue line 8.

A ring of glue is applied by an applicator nozzle 10, an outlet orifice of which is directed toward the bottom area 3 of the inside of the container jacket 2. Glue is conducted from the glue feeder line 8 to the outlet of the applicator nozzle 10 by additional glue lines 11 and 12 angled relative to each other. The glue line 12 comprises a discharge passage in the nozzle which may be closed off in the immediate vicinity of an inlet of the applicator nozzle 10 by a valve 13. The valve 13 is actuated by the control piston 5 by means of a piston rod 14 which functions as a valve lifter. The valve lifter 14 extends from the housing 4 to a stem of the valve 13. The valve lifter 14 contains a stop in the form of an annular shoulder 16, against which one end of a coil spring 15 is resting. The spring biases the stem of the valve 13 open. The annular shoulder may have a configuration such that it does not interfere with the feeding of glue, for example, by the presence of orifices therethrough.

The glue line 11 is located in a stationary tube 17. The valve lifter 14 is supported in an axially mobile manner within the glue line 11. Between the valve lifter 14 and the wall of the tube 17 the glue is conducted. The stationary tube 17 is fastened to a hub 18 of the housing 4 of the glue applicator device 1. An additional tube or carrier 19 is mounted on the stationary tube 17 for rotation about the axis A. The tube 19 is surrounded by insulation 20 so that the heated glue does not cool excessively during the feeding process.

The rotating tube 19 includes a slide member 21 which can be displaced relative to the axis A in a direction transversely of the axis A, whereby the distance of the outlet of the applicator nozzle 10 from the container jacket 2 may be adjusted. That is, the slide may contain elongated slots 22A through which fastening screws 22 extend, the screws being threaded into a tubular bearing ring 23. By loosening the screws 22, the slide and tube 21, 19 can be displaced together transversely of the bearing tube 23. The ring 23 is then fixedly connected with the slide 21 by tightening the screws 22. The bearing ring 23 is supported by means of roller bearings 26 and 27 on a stationary support sleeve 28 connected with the holder 29. In this manner the ring 23 may be rotated around the axis B together with the slide 21 and the rotating tube 19.

The rotating tube 19 is driven by a pulley 24 actuated by a toothed belt 25. The belt 25 may be driven by the drive pulley (not shown) of an electric motor, which contains a slotted disk for the control of the extent of rotation of the tube 19 and thereby control the length of an applied glue line to form a ring.

To prevent the premature freezing of the glue traveling toward the nozzle, another heater 30 is provided in the vicinity of the nozzle and is controlled by a thermostat 31.

It will be appreciated that the valve lifter 14 is supported at only one end, i.e., in the housing 4, whereby the opposite end, i.e., at the valve stem is able to float radially to a limited extent which is sufficient to enable the valve stem to become centered and close the valve, even when the rotary tube 19 has been displaced transversely so as to be slightly radially offset relative to the axis A.

The onset of the glue application may be controlled by a sensor 32 which scans the revolution of the applicator nozzle directly or indirectly.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Apparatus for applying a ring of adhesive to an adhesive-receptor surface of a jacket, comprising:

means for supporting a jacket to be coated;

a carrier mounted for rotation about an axis of rotation;

a stationary housing;

an adhesive applicator nozzle mounted on said carrier adjacent a first axial end of said carrier at a distance from said housing and having an adhesive discharge passage oriented at an angle to said axis;

an adhesive feeder line extending through said housing and communicating with said discharge passage for supplying adhesive thereto;

valve means for opening and closing said adhesive discharge passage;

rotary drive means for rotating said carrier relative to the jacket about said axis for applying a ring of adhesive to an adhesive-receptor surface of the jacket; and sensing means for sensing the position of said nozzle.

2. Apparatus according to claim 1 including means for heating said adhesive discharge passage in said nozzle.

3. Apparatus according to claim 1 including a stationary holder having means for holding a jacket such that a jacket axis is aligned with said axis of rotation, said nozzle extending into said recess for applying adhesive to an inner surface of the jacket.

4. Apparatus according to claim 1 wherein said housing has a heater to maintain the adhesive in said adhesive feeder line in a flowable state.

5. Apparatus according to claim 1, wherein said nozzle is adjustable relative to said axis in a direction transversely of said axis to vary a distance between said nozzle and an adhesive receptor surface of a jacket.

6. Apparatus according to claim 5, wherein said carrier is adjustable relative to said axis to adjust said nozzle.

7. Apparatus according to claim 5, wherein said valve means includes a valve stem disposed at one end of a valve lifter which extends coaxially relative to said axis of rotation, said valve lifter being supported at its other end to enable said valve stem to float transversely of said axis of rotation.

8. Apparatus according to claim 1, wherein said valve means is disposed at an inlet to said discharge passage.

9. Apparatus according to claim 8, wherein said valve means includes a valve lifter and a control piston connected to said valve lifter, said control piston disposed in said housing.

10. Apparatus according to claim 9, wherein said adhesive feeder line passes from said housing and into said carrier and extends through said carrier along said axis and around said valve lifter.

11. Apparatus according to claim 1 including a stationary hollow tube, said carrier comprising a hollow rotary tube rotatably mounted on said stationary tube in surrounding relationship thereto.

12. Apparatus according to claim 11, wherein said rotary tube has thermal insulation around an outer periphery thereof.

13. Apparatus according to claim 11, wherein said valve lifter extends coaxially relative to said stationary tube.

14. Apparatus according to claim 13, wherein said valve lifter extends inside said stationary tube in radially spaced relationship therefrom.

15. Apparatus according to claim 14 including a bearing ring rotatably mounted on said holder for rotation about said axis of rotation, said carrier being mounted to said bearing tube.

16. Apparatus according to claim 15 including means for adjusting said carrier relative to said bearing ring in a transverse direction relative to said axis of rotation.

17. Apparatus for applying a ring of adhesive to an adhesive-receptor surface of a jacket, comprising:

means for supporting a jacket to be coated;

a carrier mounted for rotation about an axis of rotation;

a stationary housing;

an adhesive applicator nozzle mounted on said carrier adjacent a first axial end of said carrier at a distance from said housing and having an adhesive discharge passage oriented at an angle to said axis;

an adhesive feeder line extending through said housing and communicating with said discharge passage for supplying adhesive thereto;

valve means for opening and closing said adhesive discharge passage;

rotary drive means for rotating said carrier relative to the jacket about said axis for applying a ring of adhesive to an adhesive-receptor surface of a jacket;

a stationary hollow tube, said carrier comprising a hollow rotary tube rotatably mounted on said stationary tube in surrounding relationship thereto, a valve lifter extending coaxially within said stationary tube in radially spaced relationship therefrom;

a bearing ring rotatably mounted on said holder for rotation about said axis of rotation, said carrier being mounted to said bearing ring; and means for adjusting said carrier relative to said bearing ring in a transverse direction relative to said axis of rotation.

18. Apparatus according to claim 17 including sensing means for sensing the position of said nozzle.

19. Apparatus according to claim 17, wherein said housing has a heater to maintain the adhesive in said adhesive feeder line in a flowable state.

* * * * *

UNITED STATES PATENT AND TRADEMARK OFFICE

CERTIFICATE OF CORRECTION

PATENT NO. : 4,972,797

DATED : November 27, 1990

INVENTOR(S) : Berthold MÜLLER

It is certified that error appears in the above-identified patent and that said Letters Patent is hereby corrected as shown below:

In the Title page, line [73] Assignee "GmbH & Co. KG" should read --Michael Hörauf Maschinenfabrik GmbH & Co. KG--.

Signed and Sealed this

First Day of September, 1992

*Attest:*

DOUGLAS B. COMER

*Attesting Officer*

*Acting Commissioner of Patents and Trademarks*